US006019307A

United States Patent [19]

Souma

[11] Patent Number: 6,019,307

[45] Date of Patent: Feb. 1, 2000

[54] PAPER PASTING DEVICE

[75] Inventor: Isao Souma, Kanagawa, Japan

[73] Assignee: Kabushiki Kaisha Tokyo Kikai Seisakusho, Tokyo, Japan

[21] Appl. No.: 09/122,064

[22] Filed: Jul. 24, 1998

[30] Foreign Application Priority Data

Sep. 26, 1997 [JP] Japan ..... 9-261440

[51] Int. Cl.[7] ..... B65H 19/18

[52] U.S. Cl. ..... 242/555.6; 242/554.6; 242/556.1

[58] Field of Search ..... 242/555.6, 555.5, 242/555, 555.3, 556, 556.1, 554.6

[56] References Cited

U.S. PATENT DOCUMENTS

| | | | |
|---|---|---|---|
| Re. 19,996 | 6/1936 | Wood | 242/555.6 X |
| 2,018,907 | 10/1935 | Wood | 242/555.6 X |
| 2,090,296 | 8/1937 | Hinkel | 242/555.6 |
| 3,353,765 | 11/1967 | Huck | 242/555.6 |
| 4,555,288 | 11/1985 | Nozaka | 242/555.6 X |
| 5,360,181 | 11/1994 | Hayashi et al. | 242/555.6 |

FOREIGN PATENT DOCUMENTS 6-71954 9/1994 Japan .

*Primary Examiner*—Donald P. Walsh
*Assistant Examiner*—William A. Rivera
*Attorney, Agent, or Firm*—Armstrong, Westerman, Hattori, McLeland and Naughton

[57] ABSTRACT

A paper pasting device has a depressing member depressing a paper web being fed. The paper web is depressed onto a roll of a paper web by the depressing member. The paper pasting device includes first depressing element cooperatively connected with the depressing member, for urging the depressing member toward the currently consumed paper and depressing the currently consumed paper onto the another roll of the paper web, and second depressing element provided separately from the depressing member and actuated after depressing operation of the first depressing means for contacting with a proper second portion of the depressing member and the cooperating member of the depressing member, for contacting with the proper second position of the depressing member and the cooperating member and reinforcing a depressing force by the depressing member.

4 Claims, 9 Drawing Sheets

PAPER PASTING DEVICE

BACKGROUND OF THE INVENTION

1. Field of the Invention

The present invention relates to a flying type paper pasting device to be employed in a paper feeding portion of a rotary press continuously supplying a paper web, which pasting device is provided with an adhering portion for pasting papers by an adhesive double coated tape, and a web paper take-up body placed at a stand-by state in a condition where an end of paper is temporarily adhered on a peripheral surface is driven to rotate at a peripheral speed substantially equal to a currently consumed paper being fed, for pasting paper by depressing the currently consumed paper on to the end of the paper on the roll of paper being driven to rotate by means of a depressing member.

2. Description of the Related Art

A prior art of a paper pasting device of the type, to which the present invention concerns, has been disclosed in Japanese Examined Patent Publication No. Hei 6-71954. In the paper pasting device disclosed in the above-identified publication, a support shaft is rotatably supported between frames of a paster arm portion of the paper pasting device. On the support shaft, a depressing member is integrally secured for rotation therewith. On the support shaft, a spring for causing quick movement of the depressing member toward the currently consumed paper, is mounted.

On the other hand, on the support shaft, an arm is mounted with integrally securing one end thereof. The other end of the arm is connected to a rod of an air cylinder connected on the side of the frame of a paster arm portion On the other hand, in order to maintain the depression member in the stand-by state within the paster arm portion against a spring force, a stopper preventing the support shaft from rotating, is provided on a frame surface of the paster arm. The stopper is actuated by a solenoid. When the solenoid is actuated in response to a command from a control unit, rotation of the support shaft is permitted.

Then, the support shaft is quickly rotated by a force of the spring. The depressing member fixed on the support shaft is moved toward the currently consumed paper.

Subsequently, an electromagnetic switching valve disposed in the air cylinder is switched in response to the command from the control unit to actuate the air cylinder for driving the depressing member fixed on the support shaft in a direction toward the currently consumed paper.

With the construction set forth above, on the basis of a timing control of the control unit, the solenoid is actuated and thus, the stopper permits rotation of the support shaft. Then the depressing member is abruptly moved toward the currently consumed paper by the force of the spring for depressing the currently consumed paper onto the roll of paper driven to rotate at substantially the same peripheral speed as the currently consumed paper. Upon depression, a reaction force from the roll of paper acts on the depression member to cause bounding of the depressing member.

However, upon occurrence of the reaction force, the air cylinder is actuated. Against this reaction force, depressing force of the depressing member is applied for restricting bounding of the depressing member so that pasting of the paper web can be performed without causing delay of timing.

However, in the prior art set forth above, the depressing body is integrally fixed on the support shaft which is driven to cause angular displacement by the spring, and the arm connected to a rod of the air cylinder in order to restrict bounding of the depressing member is also integrally fixed to the support shaft.

Accordingly when the solenoid is actuated by the control unit to release the stopper to pivotally move the depressing member toward the currently consumed paper according to angular displacement of the support shaft by a spring force exerted by the spring, the arm connected to the rod of the air cylinder is integrally moved and the rod of the air cylinder is also moved.

Therefore, at this time, a friction force at the contacting portion between a piston of the air cylinder and the rod and the rod cover serves as a resistance against movement of the depressing member by the spring to cause difficulty in depressing of the currently consumed paper onto the roll of paper being driven to rotate, at a desired timing and thus to possibly cause failure of pasting of paper.

In order to restrict bounding of the depressing member, the air cylinder and the control unit or so forth for actuating the air cylinder are provided to make the device complicated.

SUMMARY OF THE INVENTION

It is an object of the present invention to provide a paper pasting device which make it unnecessary to provide an air cylinder and a control unit or so forth for actuating the air cylinder as means for restricting bounding of a depressing member and thus can form the means for restricting bounding of a depressing member with a quite simple construction.

Another object of the present invention is to provide a paper joining device of the type, in which the air cylinder and the control unit or so forth for actuating the air cylinder are provided in the means for restricting bounding of the depressing member as in the prior art, operation of the depressing member by a spring and operation of the air cylinder may not cause mutual interference to suppress bounding after operation of the depressing member to quickly stabilize the depressing member on the peripheral surface of the roll of paper for enabling further accurate joining of the paper.

In order to accomplish the above-mentioned objects, according to the first aspect of the present invention, a paper joining device having a depressing member depressing a currently consumed paper extracted from one of a plurality of rolls of paper web supported on a support device, onto a pasting portion provided on a paper end of another roll of the paper web, which another roll is driven to rotate at a peripheral speed substantially the same as a feeding speed of the currently consumed paper, comprises:

first depressing means cooperatively connected with the depressing member, for abruptly moving the depressing member toward the currently consumed paper and depressing the currently consumed paper onto the another roll of paper web; and brake means provided in the vicinity of a proper first portion of the depressing member and the cooperating member of the depressing member, for braking bounding of the depressing member caused by a reactive force generated in response to a depressing force of the first depressing means by contacting with the first portion causing resilient deformation by a force in a feeding direction applied from the currently consumed paper associating with actuation of the first depressing means.

According to the second aspect of the present invention, a paper pasting device having a depressing member depressing a currently consumed paper extracted from one of the plurality of rolls of paper web supported on a support device, onto a pasting portion provided on a paper end of another roll of paper web, which another roll is driven to rotate at a peripheral speed substantially the same as a feeding speed of the currently consumed paper, comprising:

first depressing means cooperatively connected with the depressing member, for quickly moving the depressing member toward the currently consumed paper and depressing the currently consumed paper onto the another roll of the paper web;

second depressing means provided separately from the depressing member and actuated after depressing operation of the first depressing means for contacting with a proper second portion of the depressing member and the cooperating member of the depressing member, for contacting with the proper second portion of the depressing member and the cooperating member and reinforcing depressing force by the depressing member; and brake means provided in the vicinity of a proper first portion of the depressing member and the cooperating member of the depressing member, for braking bounding of the depressing member caused by a reactive force generated in response to a depressing force of the first depressing means by contacting with the first portion causing resilient deformation by a force in a feeding direction applied from the currently consumed paper associating with actuation of the first depressing means.

In the construction set forth above, the first depressing means may comprise a shaft fixing a base portion of the depressing member, rotatably supported on a frame of the paper pasting device and having a projecting portion projecting from an outer peripheral surface thereof, a spring provided for causing angular displacement of the shaft for moving the depressing member rotating integrally with the shaft, and a stopper preventing the shaft from causing angular displacement against a spring force of the spring, the depressing member may be quickly moved toward the currently consumed paper by the spring force of the spring when the stopper is placed in ineffective position, and the brake means may have a concave curved surface in opposed to the outer periphery of the shaft and substantially complementary with the outer periphery, a base portion mounted on the frame, and the concave curved surface may have at least a portion opposing to the feeding direction of the current consumed paper.

Also, the second depressing means may have a sleeve portion having an inner diameter greater than an outer diameter of the shaft at one end and includes an arm loosely mounted on the shaft by the sleeve portion and an air cylinder having a rod connected to a tip end of the arm at a tip end thereof in an angularly displaceable fashion and mounted on the frame via a bracket in an angularly displaceable fashion, the arm may be driven to cause displacement about a contacting position between the shaft and the sleeve portion by actuation of the air cylinder applied a force in a rotating direction of the shaft for reinforcing a depressing force of the depressing member by the spring.

In the construction set forth above, under the condition where consumption of the paper web extracted from one roll of the paper web is progressed in excess of a predetermined amount, the depressing member is quickly depressed onto the currently consumed paper being fed. Then, the currently consumed paper is depressed onto a new roll of the paper web driven to rotate at a peripheral speed substantially the same as the feeding speed of the currently consumed paper.

The member cooperated with the depressing member actuated by actuation of the first depressing means is resiliently deformed by a force exerted from the currently consumed paper. By resilient deformation, proper positions of the depressing member and the cooperating member cooperated with the depressing member are contacted with brake means so that bounding caused by pushing back of the depressing member can be restricted by a reaction force received from the roll by a frictional resistance by the brake means.

After actuation of the first depressing means, the second depressing means are actuated to reinforce depressing force in the moving direction of the depressing member by contacting with the proper portion of the depressing member and the cooperating member cooperated with the depressing member.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscure the present invention.

Figure 1:
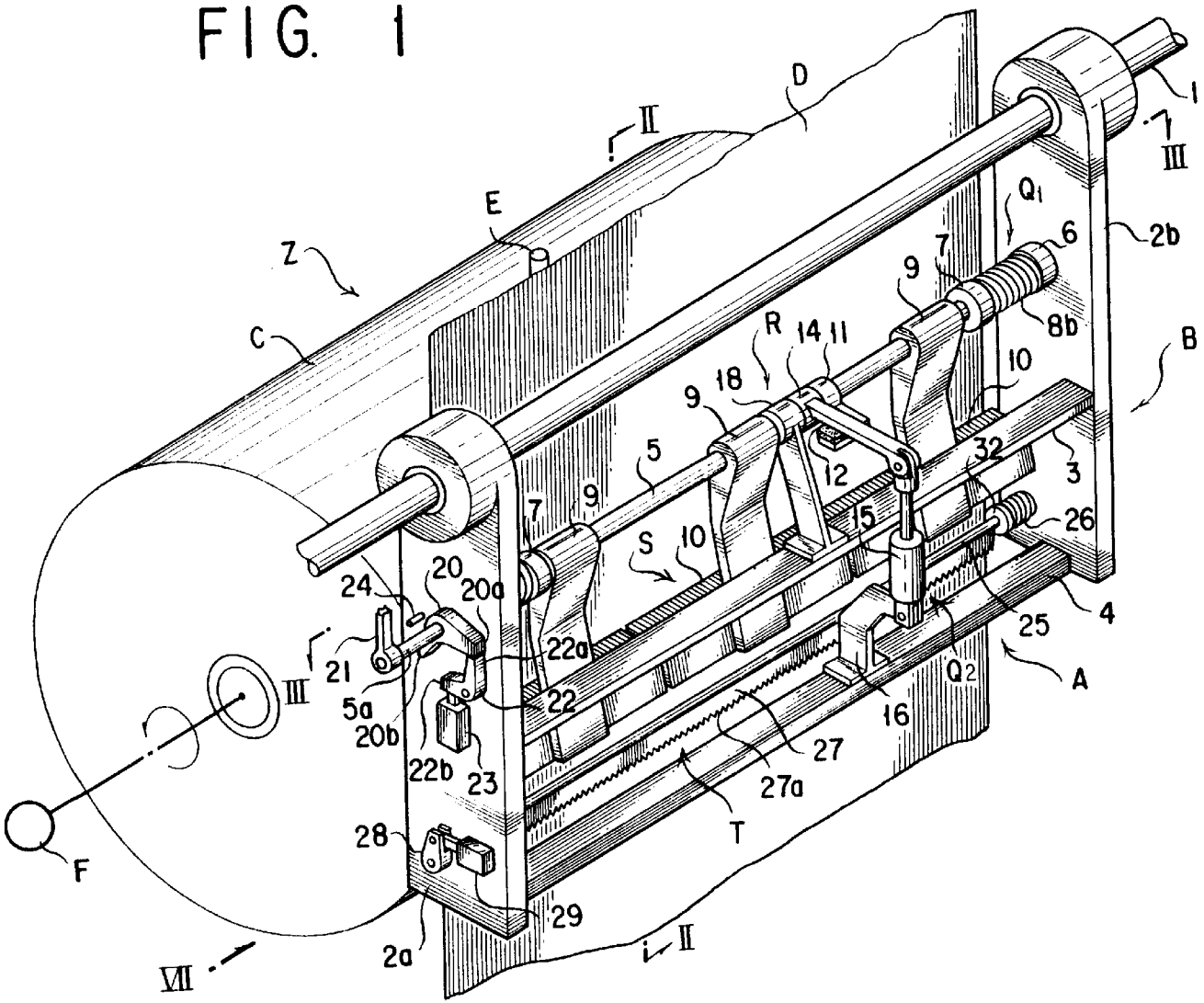
FIG. 1 is a perspective view of the preferred embodiment of a paper pasting device according to the present invention.
Figure 2:
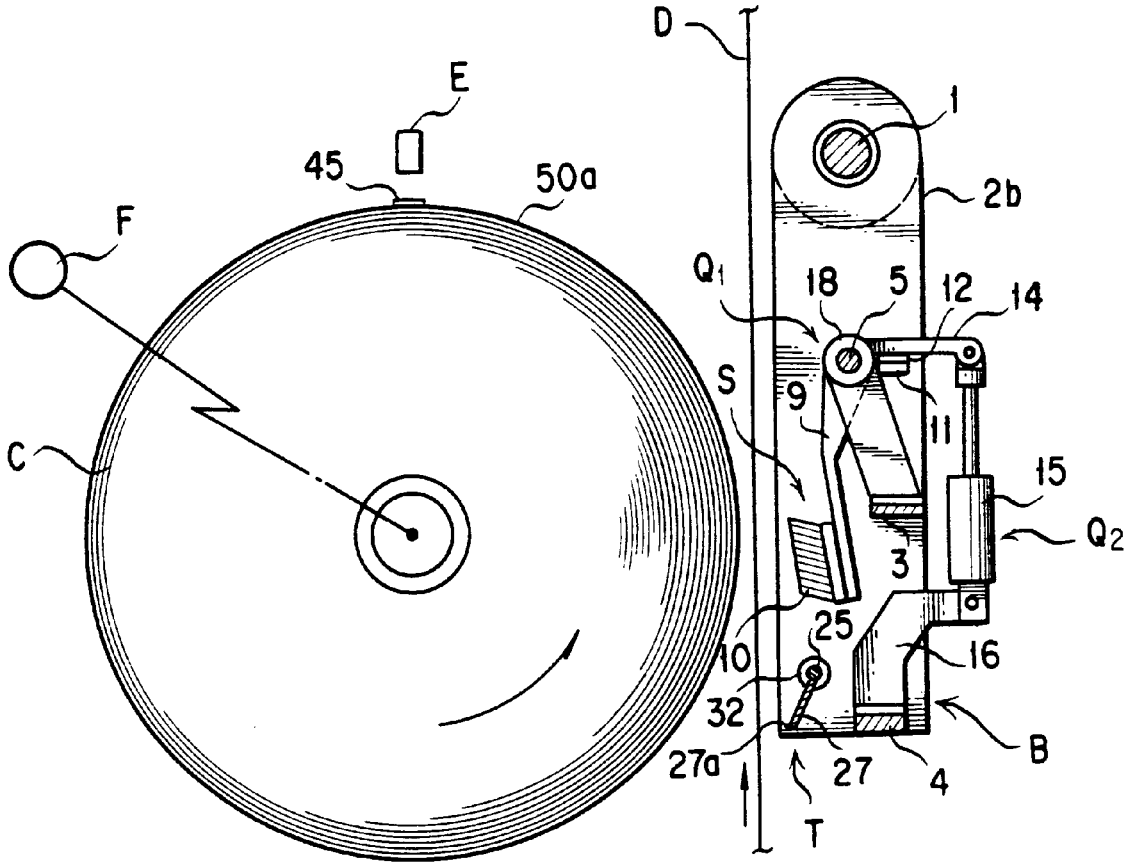
FIG. 2 is a section taken along line II—II of FIG. 1.
Figure 3:
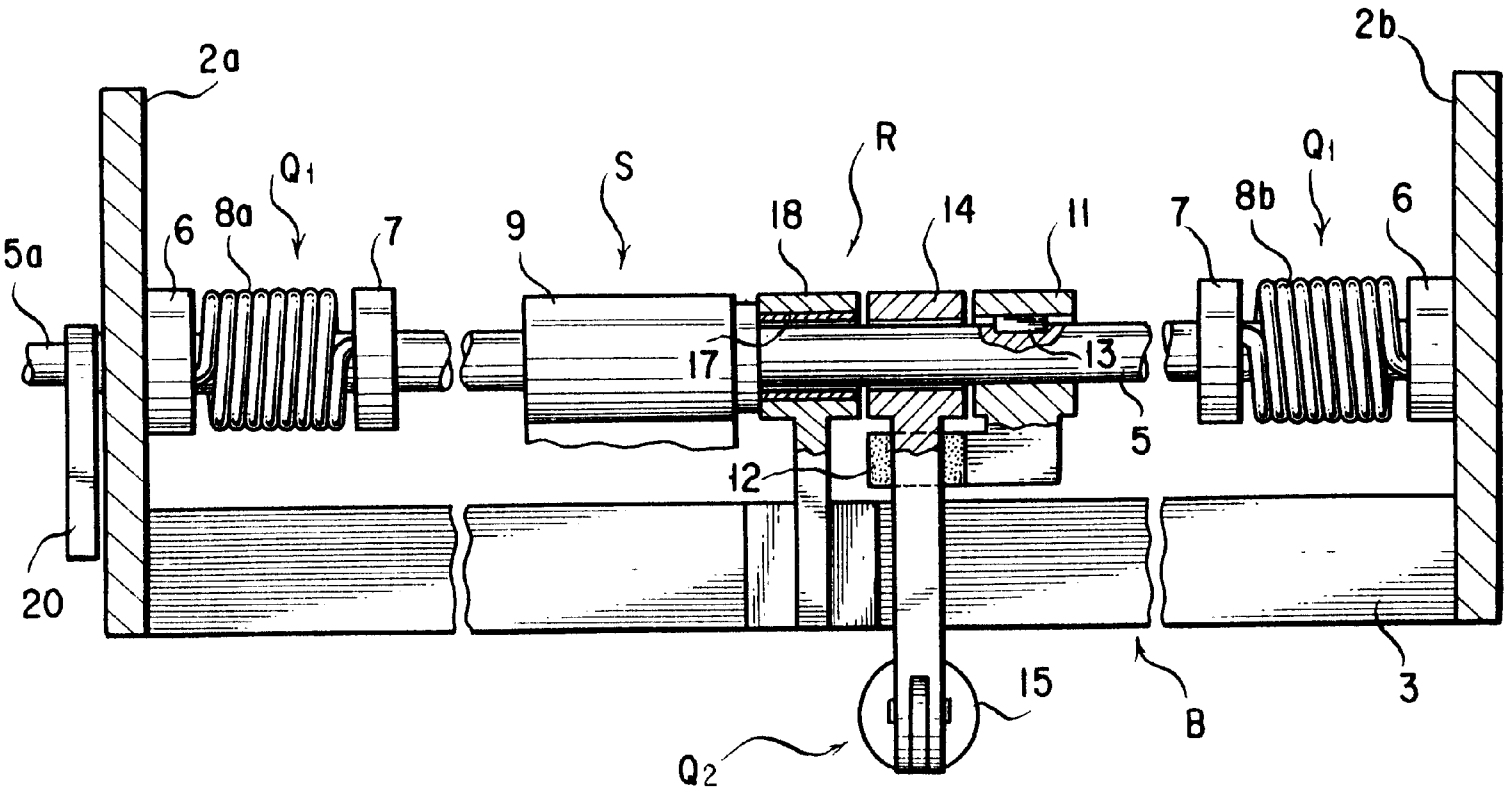
FIG. 3 is a section taken along line III—III of FIG. 1.
Figure 4:
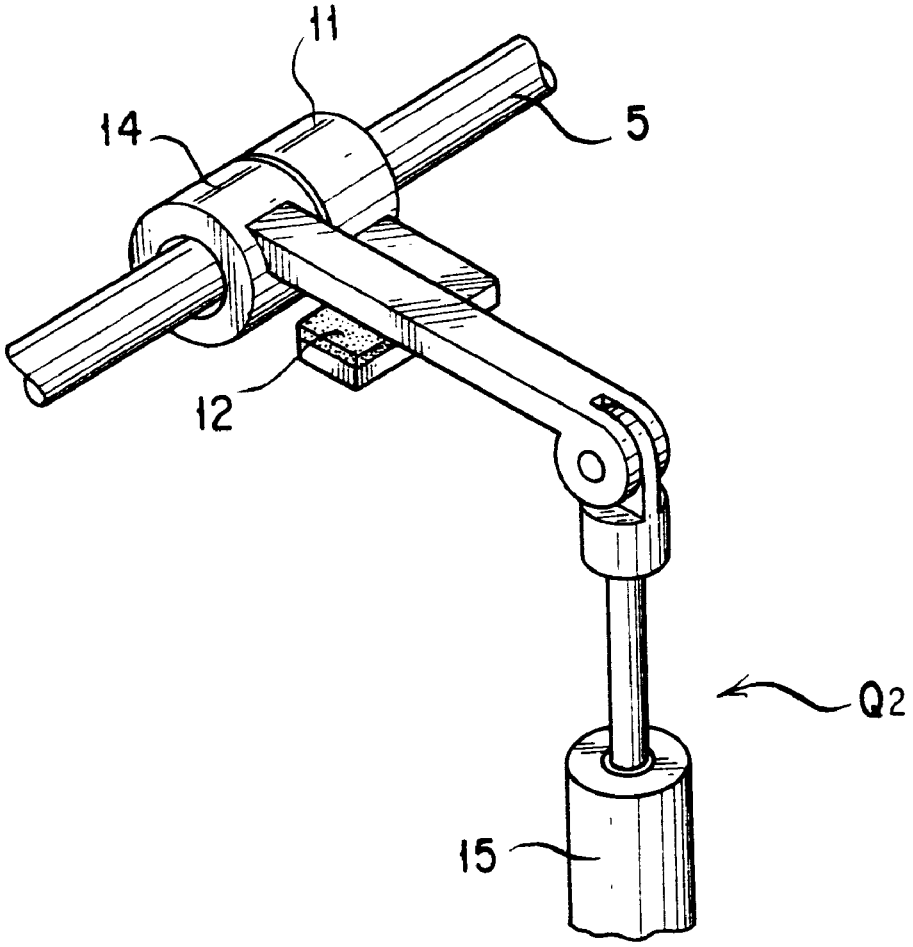
FIG. 4 is an enlarged perspective view of a depressing means.
Figure 5:
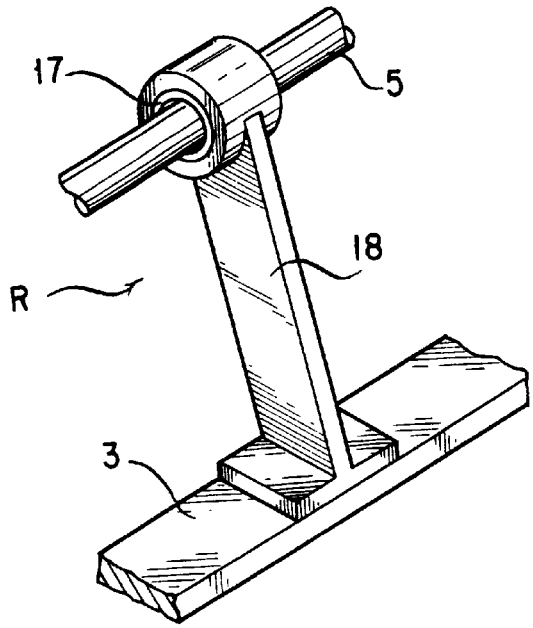
FIG. 5 is an enlarged perspective view of a brake means.
Figure 6:
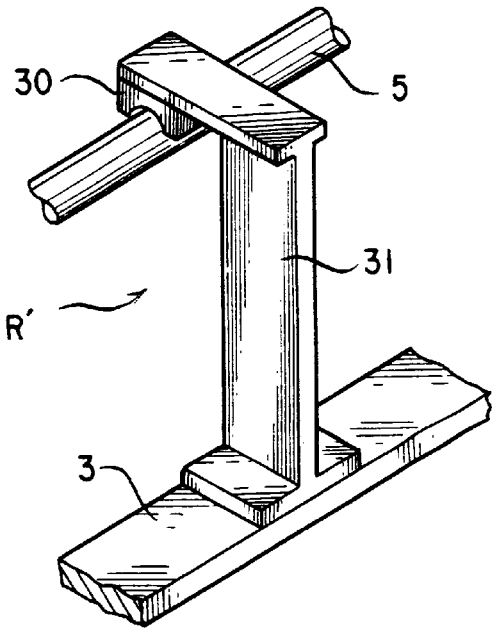
FIG. 6 is an enlarged perspective view of a brake means.
Figure 7:
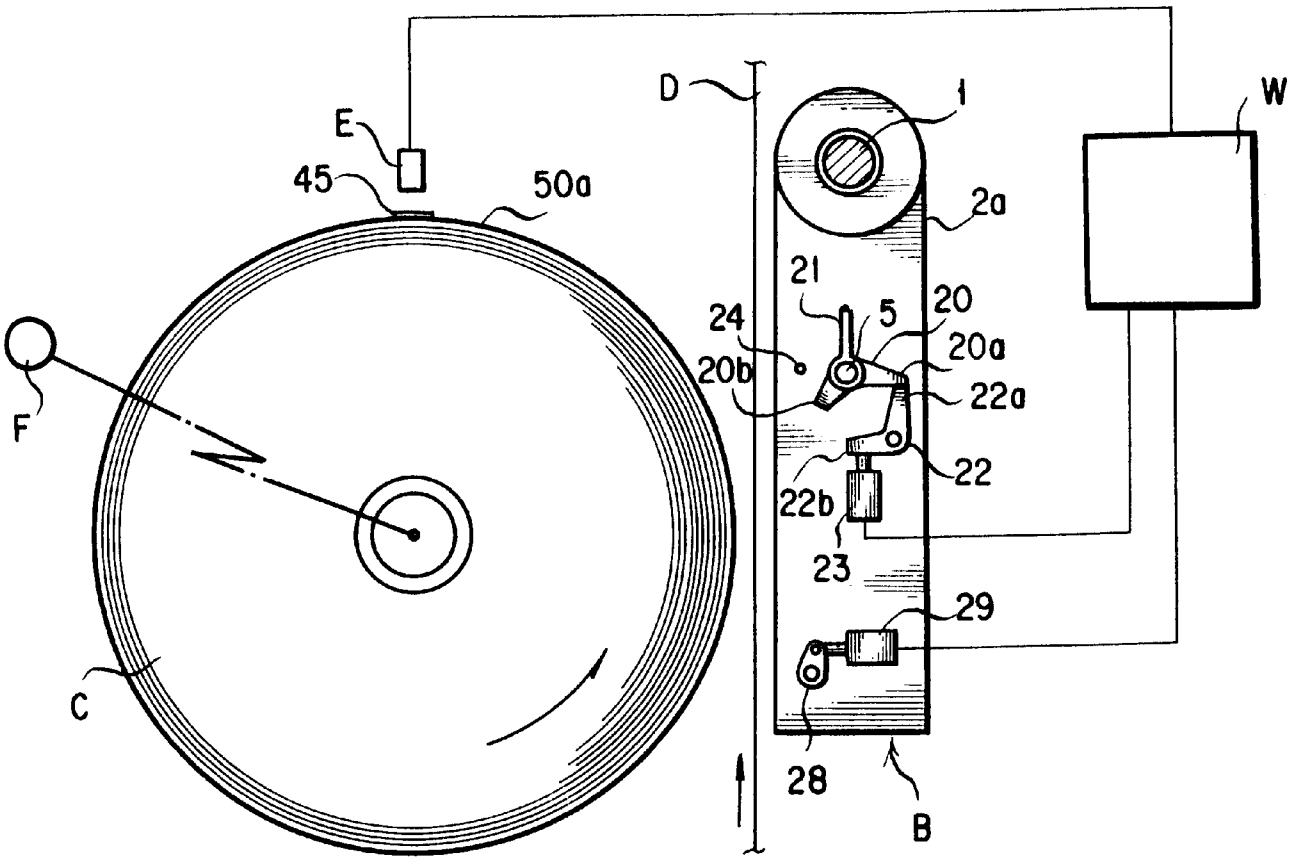
FIG. 7 is a view along an arrow VII of FIG. 1.

Referring to the drawings, FIG. 1 is a perspective view of the preferred embodiment of a paper pasting device according to the present invention, FIG. 2 is a section taken along line II—II of FIG. 1, FIG. 3 is a section taken along line III—III of FIG. 1, FIG. 4 is an enlarged perspective view of a depressing means, FIG. 5 is an enlarged perspective view of a brake means, FIG. 6 is an enlarged perspective view of a brake means, FIG. 7 is a view along an arrow VII of FIG.

Figure 8:
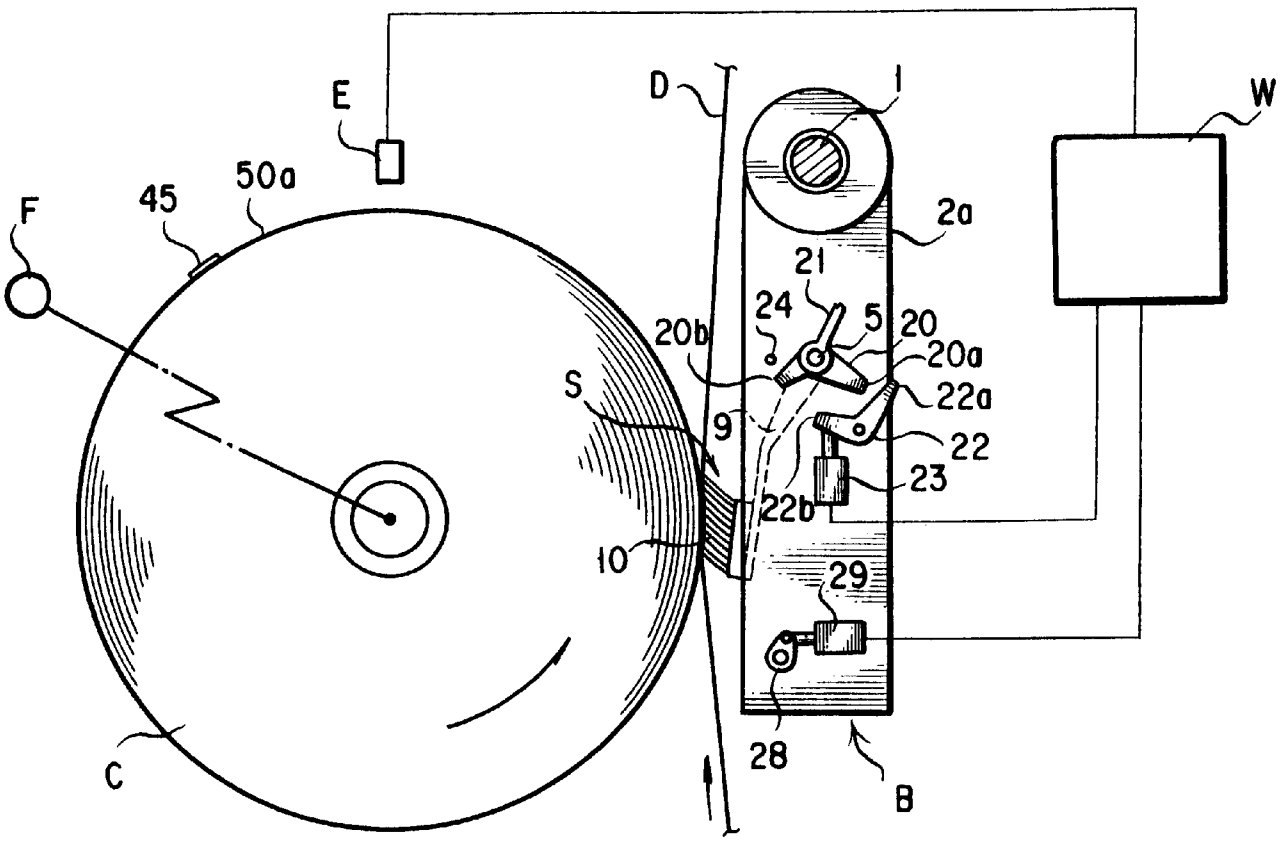
FIG. 8 is an explanatory illustration showing operation of depressing member of FIG. 7.
Figure 9:
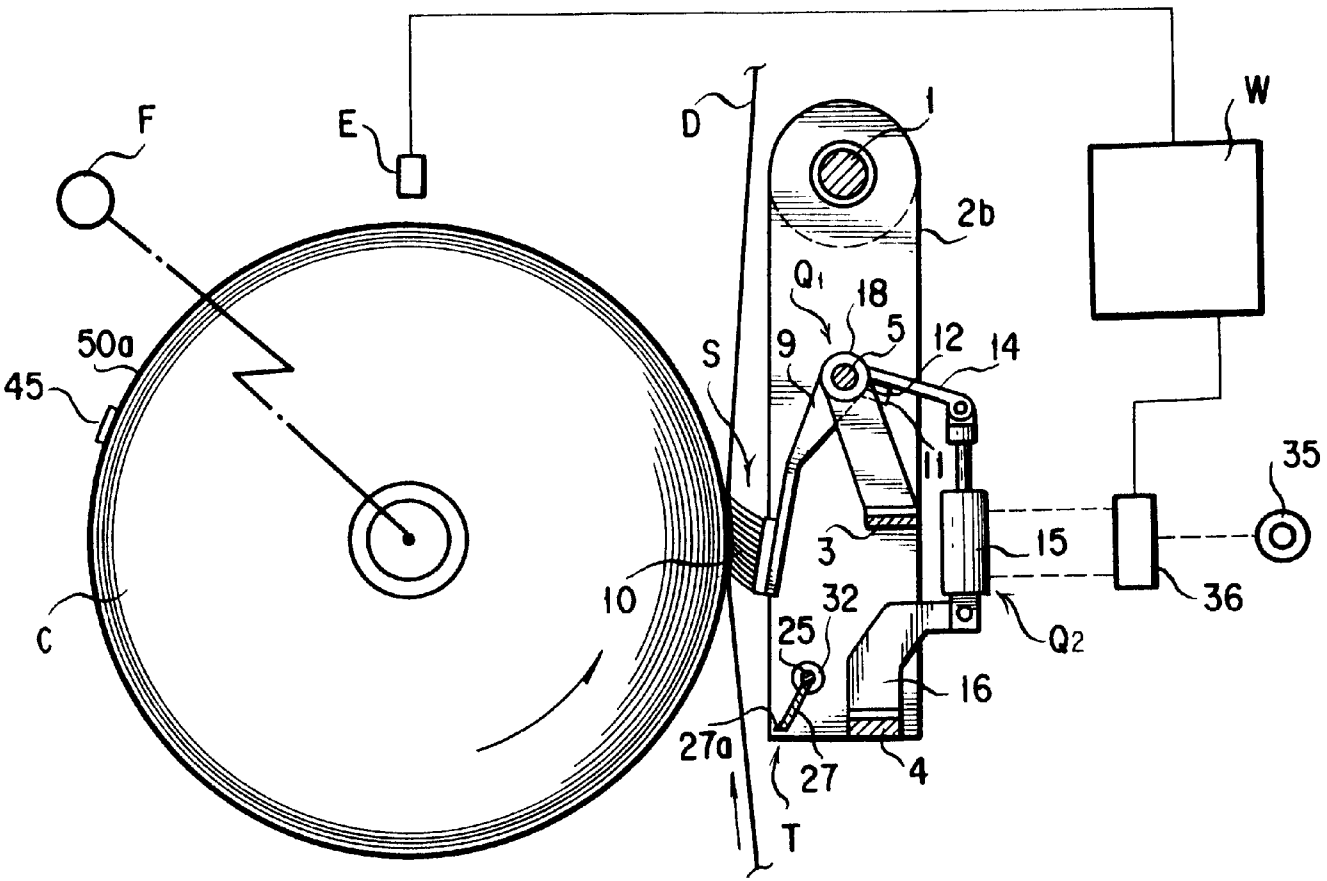
FIG. 9 is an explanatory illustration showing an operation of the depressing member of FIG. 2.
Figure 10:
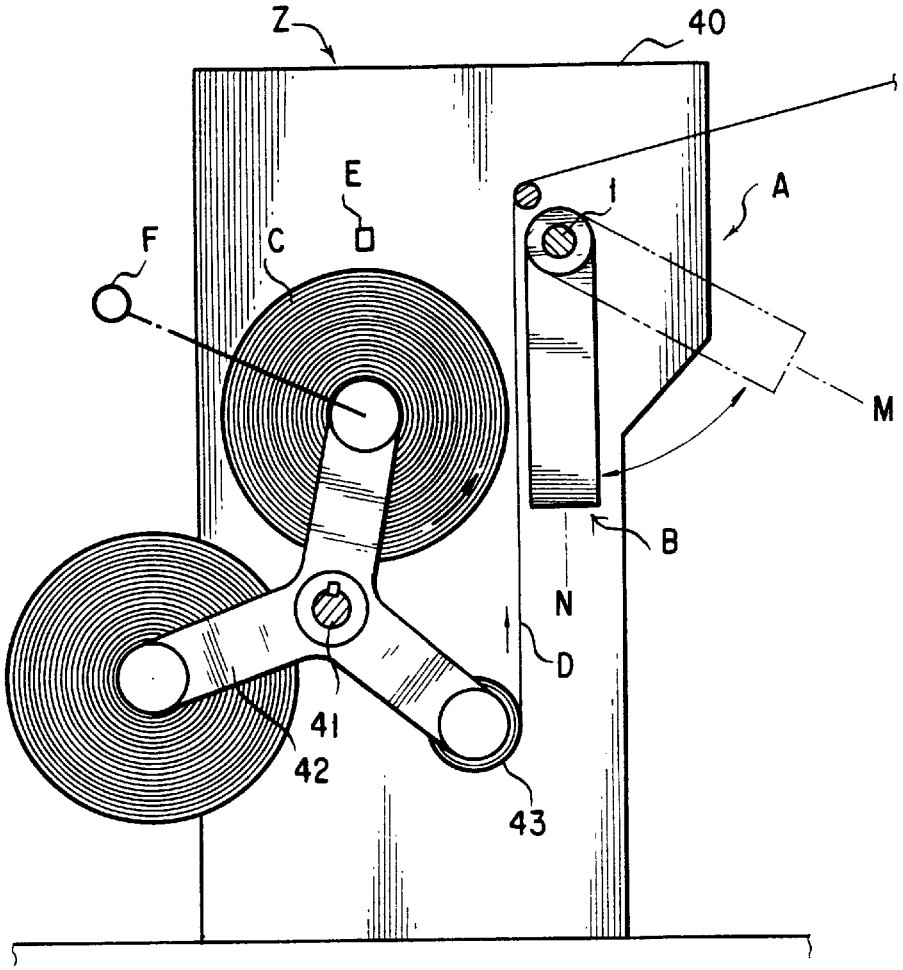
FIG. 10 is an illustration showing a general construction showing a paper feeding portion of a rotary press according to the present invention.
Figure 11:
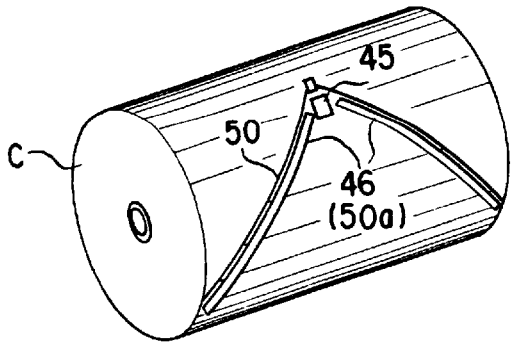
FIG. 11 is a perspective view showing a roll of paper provided with a pasting portion for pasting a paper.

1, FIG. 8 is an explanatory illustration showing operation of depressing member of FIG. 7, FIG. 9 is an explanatory illustration showing an operation of the depressing member of FIG. 2, FIG. 10 is an illustration showing a general construction showing a paper feeding portion of a rotary press according to the present invention, and FIG. 11 is a perspective view showing a roll of paper provided with a pasting portion for pasting a paper.

In a paper feeding portion Z of a rotary press shown in FIG. 10, a shaft 41 is rotatably supported between frames 40 provided in parallel relationship with each other with a given distance. On the shaft 41, a substantially Y-shaped arms 42 are mounted for serving as a support device supporting a paper web take-up bodies in opposition with each other. Each of three arm segments of the mutually opposing Y-shaped arms 42 are located in opposition with each other and supports the roll of paper.

On the obliquely upward position of the shaft 41, a shaft 1 is secured between the frames 40 in parallel relationship with the shaft 41. On the shaft 1, a paster arm portion B of a paper pasting device A is pivotably mounted for rotation thereabout for pivoting between a stand-by position M as illustrated by a phantom line in FIG. 10 and a paper pasting position N as illustrated by a solid line.

On an end of one arm segment of the Y-shaped arm, the roll 43 of paper which will be hereinafter referred to as "spending roll" is supported. A paper web D (hereinafter referred to as "currently consumed paper") to be printed by a not shown printing portion is fed upwardly from the spending roll 43.

In a paster arm portion B of the paper pasting position N, on ends of another arm segments of the Y-shaped arms 42, which arm segments are located in opposition across the currently consumed paper D, a brand-new roll of the paper C which is not pasted and will be hereinafter referred to as a "new roll", is supported. On the upper side of the new roll C, a detecting means E, such as a photoelectric sensor for detecting a paper pasting position on a peripheral surface of the roll, is fixed between the frames 40 by means of not shown brackets in downwardly directed orientation.

As shown in FIG. 11, on the peripheral surface of the new roll C, a paper end 50 cut into V-shaped configuration at the tip end edge thereof is temporarily adhered by an adhesive tape or the like.

Along the V-shaped edge on the surface of the paper end 50, a detection piece 45, such as a black tape, the surface of which is coated with an adhesive material is pasted for indicating a paper pasting position to be detected by the detecting means E.

The new roll C is adapted to be preliminarily driven to rotate at the same peripheral speed as the speed of the currently consumed paper D in a counterclockwise direction shown in FIG. 10 by a proper driving means F, upon pasting of paper.

In the paster arm portion B shown in FIG. 1, arms 2*a* and 2*b* are rotatably mounted on the shaft 1. Between the arms 2*a* and 2*b*, a stay 3, 4 is fixed in parallel to the shaft 1. By this, both arms 2*a* and 2*b* are integrated to form the paster arm portion B.

In the paster arm portion B, a depressing member S, a first depressing means Q1, a second depressing means Q2, a brake means R and a cutting means T are provided.

These elements will be discussed hereinafter in detail.

(1) Depressing Member S

The depressing member S is mounted on a shaft 5 as a cooperating member cooperated with the former.

Namely, a plurality of arms 9 (for example, three in the shown embodiment) of the depressing member S are fixed on the shaft with a given interval in an axial direction of the shaft 5. The shaft 5 is rotatably supported on both arms 2*a* and 2*b* in parallel relationship with the shaft 1. On the side surfaces of the end portions of the arms opposing to the currently consumed paper D, brushes 10 are secured.

(2) First Depressing Means Q1

Insides of both arms 2*a* and 2*b* of the paster arm portion B, blocks 6 are secured. On the blocks 6, both end portions of the shaft 5 of the depressing member S are rotatably supported.

Then, one axial end portion 5*a* of the shaft is extended outwardly through one arm 2*a*.

In a space between opposing inner sides of both blocks 6, collars 7 are fixed on the shaft 5 in mutually spaced apart relationship. On the shaft 5 between each block 6 and the collar 7, springs 8*a* and 8*b* as torsion coil springs are provided coaxially with the center axis of the shaft 5. End portions of each spring 8*a* and 8*b* are inserted into holes formed on the side surfaces of the block 6 and the collar 7 for restraining.

By this, the shaft 5 is applied a rotational force in a clockwise direction by springs 8*a* and 8*b* in FIG. 1 via the collars 7.

Accordingly, the depressing member S fixed on the shaft 5 is adapted to cause angular displacement toward the currently consumed paper D.

On the side surface of the arm 2*a*, an L-shaped hook 20 is fixed on the axial end portion 5*a* of the shaft 5. On the lower side of the hook 20, an L-shaped stopper 22 is rotatably supported on a pin fixed on the arm 2*a*. The stopper 22 is biased by a rotational force in counterclockwise direction in FIG. 1 by a torsion coil spring (not shown) provided properly.

One end portion 22*a* of the stopper 22 contacts with the end portion 20*a* of the hook 20 for restricting angular displacement of the hook 20. Opposing an outer side surface of the arm 2*a* located on the lower side of the other end portion 22*b* of the stopper 22, a solenoid 23 is secured so that the stopper 22 may contact with the other end portion 22*b* in the condition where a plunger of the solenoid 23 is retracted.

A paper pasting operation of the depressing member S by the first depressing means Q1 is performed by actuating the solenoid 23 receiving the signal from a control unit W which will be discussed later, to expand the plunger to cause angular displacement of the stopper 22 for releasing the hook 20 by making action of the stopper ineffective, and thus causing quick angular displacement of the shaft 5 by spring forces of the springs 8*a* and 8*b* and whereby causing quick angular displacement of the depressing member S.

On the other hand, after termination of the paper pasting operation, the paster arm portion B shown in FIG. 10 is moved from the paper pasting position N to the stand-by position M. Upon movement, in order to avoid the depressing member S to excessively extend from the paster arm portion by own weight of the depression member S and rotational force of the springs 8*a* and 8*b* despite of the fact that the hook 20 is placed in the releasing state, a stopper 24 is fixed on a proper position of the outer side surface of the arm 2*a* within a range of angular displacement of the end portion 20*b* of the hook 20.

Furthermore, on the tip end of the axial end portion 5*a* extending from the arm 2*a* on the shaft 5, an arm 21 is secured. In a process to return the paster arm portion B to the stand-by position M shown in FIG. 10, the arm 21 is rotated in the opposite direction of rotational force of the springs 8*a* and 8*b*, by the action of not shown depressing means.

Then, by retraction of the plunger of the solenoid in response to a signal from the control unit W, the stopper 22 causes angular displacement by the spring force of the not shown torsion coil spring to return to a position where the hook 20 is restricted angular displacement by the stopper 22 and thus to be placed in the stand-by state.

(3) Second Depressing Means Q2

As shown in FIGS. 3 and 4, the second depressing means Q2 has an arm 11 to be a projecting portion projecting from the outer peripheral surface of the shaft 5, is fixed on the shaft 5 by a key 13. The arm 11 is formed into a shape, in which an arm portion projecting from the shaft 5 in a direction away from the currently consumed paper D, is bent to direct the tip end portion thereof in parallel to the axis of the shaft 5. On the bent tip end portion of the arm portion of the arm 11, a buffer member, such as rubber 12 or the like, is mounted. Adjacent to the arm 11, an arm 14 has a sleeve portion having an inner diameter greater than the outer diameter of the shaft at one end to be loosely mounted on the shaft 5. The arm 14 is provided substantially horizontally in a direction away from the currently consumed paper D.

Then, the arm 11 is located at one axial side of the sleeve portion of the arm 14. On the other side of the sleeve portion of the arm 14, a sleeve 17 of the brake means R which will be discussed later, or a block 30 is located. By these, movement of the arm 14 is restricted. Immediately below the arm portion of the arm 14, the rubber 12 carried by the arm 11 is located.

On a free end of the arm portion of the arm 14 extending in substantially horizontal direction, a tip end of the rod of the air cylinder 15 in the extended position is connected in a condition permitting angular displacement. A main body of the air cylinder is connected with a bracket 16 fixed on the stay 4 shown in FIG. 1 in a condition permitting angular displacement.

As shown in FIG. 9, to the air cylinder 15, an air supply piping from an air source 35 is connected via an electromagnetic switching valve 36 provided at a proper position.

(4) Brake Means R

As shown in FIGS. 3 and 5, between the arm 14 of the second depressing means Q2 mounted on the shaft 5 as the connecting member of the depressing member S and the arm 9 of the depressing member S, the cylindrical sleeve 17 having a concave curved surface having an inner diameter slightly greater than the diameter of the shaft 5 is arranged in a form inserted the shaft 5 therethrough. The sleeve 17 is fixed on the bracket 18 and is supported so that the center axis of the shaft 5 coincides with the center axis of the sleeve 17. Then, the base portion of the bracket 18 is fixed to the stay 3.

On the other hand, as an alternative embodiment of the brake means R shown in FIG. 5, a brake means R' shown in FIG. 6 is provided. The block 30 having a concave curved surface opposing a small gap along the upper peripheral surface of the shaft 5 in the upper side of the shaft 5 is fixed on the bracket 31 which is fixed on the stay 3.

(5) Cutting Means T

As shown in FIGS. 1 and 2, in the lower position of the depressing member S within the paster arm portion B, a shaft 25 is supported on the arms 2*a* and 2*b* in rotatable fashion. One end portion of the shaft 25 is extended outwardly through one arm 2*a*.

On the shaft 25 located between the arms 2*a* and 2*b*, a cutter 27 having a cutting edge 27*a* provided with jagged teeth along the shaft 25, is mounted in a condition projecting from the shaft 25, directed obliquely downward on the side of the currently consumed paper D, in a condition projecting from the shaft 25.

On the other hand, on the shaft 25, the spring 26 as a torsion coil spring is provided with aligning the center axis thereof with the center axis of the shaft 25. Then, one end portion of the spring 26 is inserted into the hole provided on the inner surface of the arm 2*b* to be restrained. On the other hand, the other end portion is inserted into the hole provided on the side surface of the collar 32 fixed on the shaft 25 to be restrained. The shaft 25 is biased by the rotational force in the counterclockwise direction in FIG. 1, by the spring 26 via the collar 32.

On the end portion of the shaft 25 projected outwardly from the arm 2*a*, an arm 28 is fixed. The end portion of the arm 28 is oriented upwardly. On the outer side surface of the arm 2*a*, a solenoid 29 is fixed adjacent the arm 28. A plunger of the solenoid 29 is connected to the tip end of the arm 28. In the shown construction, the plunger of the solenoid 29 is held in the extended position.

Operation of the paper pasting device constructed as set forth above will be discussed hereinafter.

(1) In FIG. 10, when consumption of the paper D extracted from the spending roll is progressed, the paster arm portion B of the paper pasting device A is moved from the stand-by position M to the paper pasting position N and stopped at the paper pasting position N.

Then, the driving means F is actuated so that the new roll C may be driven to rotate at a peripheral speed substantially equal to the feeding speed of the currently consumed paper D.

(2) When a diameter of the spending roll 43 reaches a predetermined critical diameter for paper pasting, the detecting means E detects the detecting piece 45, such as a black tape or so forth stacked on the paper end 50 of the new roll C and having adhering property on the surface to generate a detection signal, as shown in FIG. 7.

When the detection signal is received by the control unit W, the control unit W feeds actuation signal to the solenoid 23 and the electromagnetic switching valve 26 for enabling the depressing member S to depress the currently consumed paper D onto the peripheral surface of the new roll C, instantly or before the detection piece of the new roll C reaches the paper pasting position where the depressing member S acts.

(3) When the plunger of the solenoid 23 is extended to release the stopper 22 from the hook 20, the depressing member S is quickly moved to depress the currently consumed paper D onto the new roll C by the spring force of the springs 8*a* and 8*b*.

Then, due to the influence of the force in the feeding direction of the currently consumed paper D, an upward force acts on the depressing member S to upwardly lift the shaft 5 via the arm 9. Thus, upward deflection is caused on the shaft 5.

Then, the deflecting shaft 5 contacts with the inner peripheral surface of the sleeve 17 of the brake means R provided at the center portion of the shaft 5.

(4) On the other hand, at this time, by a reaction force due to quick depression of the depressing member onto the new roll, the brush 10 causes bounding. Then, a force acting in a reverse direction is exerted on the shaft to act for causing rotation of the shaft in the counterclockwise direction.

However, since the shaft 5 is in contact with the sleeve 17 of the brake means S, the force in the reverse direction is restricted by a frictional resistance to minimize bounding of the brush 10 of the depressing member R.

(5) Furthermore, at this time, the electromagnetic switching valve 36 which receives the actuation signal from the control unit W together with the solenoid 23, is initiated substantially at the same timing as the solenoid 23. However, due to the difference in the construction, a timing of end of operation of the electromagnetic switching valve 36 is delayed. In addition, due to the length of the air path of the air cylinder 15, the air cylinder 15 operates to contract the rod with a slight delay relative to the contacting timing of the solenoid 23.

By this, as shown in FIG. 9, associating with contraction of the rod of the air cylinder 15, the arm of the second depressing means Q2 quickly causes angular displacement in the clockwise direction about the shaft 5.

(6) Then, the lower surface of the arm 14 abuts onto the rubber 12 of the arm 11 which is going to cause the angular displacement in the counterclockwise direction due to bounding of the brush 10. The rubber 12 serving as the buffer member absorbs impact upon collision of the arm 11 and the arm 14 to quickly exert the depressing force of the air cylinder 15 to the arm 11 to suppress bounding of the brush 10 of the depressing member S via the shaft 5, and reinforce depressing force of the depressing member S by the springs 8*a* and 8*b*.

(7) By action of the first depressing member Q1, the depressing member S depressing the currently consumed paper D onto the peripheral surface of the new roll C is quickly stabilized in the depressed condition by the action of the second depressing means Q2 and the brake means R. Thus, sticking of sticking portion 50*a* of the paper end 50 of the new roll C and the detection piece 45 can be surely performed to paste the paper.

(8) Subsequently, at a proper timing, a signal is output from the control unit W to actuate the solenoid 29 of the cutting means T. When the plunger is contracted, a cutting edge 27*a* of the cutter 27 is moved against a force of the spring 26 to cut the currently consumed paper D.

(9) After completion of pasting of paper, a signal for deenergization is output from the control unit W to deenergize the solenoid 29. Then, the plunger of the solenoid 29 becomes free condition to return to the cutter 27 to a stand-by state by the spring force of the spring 26 shown in FIG. 1. Then, the cutting edge 27*a* of the cutter 27 also moves to the stand-by state to be retracted within the paster arm portion B. Associating with this, the plunger of the solenoid 29 is also moved frontwardly to be placed at the stand-by state. Then, the electromagnetic switching valve 36 receiving the signal from the control unit W is switched to extend the rod of the air cylinder 15 frontwardly to move the arm 14 of the second depressing means Q2 in the stand-by state.

(10) By not shown moving means, the paster arm portion B is moved from the paper pasting position N to the stand-by position M. Associating with this, the depressing member S is further moved toward the new roll C by the spring force of the springs 8*a* and 8*b*. According to the movement of the paster arm portion B, the end portion 20*b* of the hook 20 is contacted with the stopper 24 to block further movement of the depressing member S toward the new roll C.

Then, not shown depressing means provided at proper position before reaching the stand-by position M acts on the arm 21 provided on the end portion of the shaft 5 to cause rotation of the shaft in the counterclockwise direction to move the depressing member S to be retracted into the paster arm portion B. Associating with this, the hook 20 causes displacement for providing sufficient space for permitting the stopper 22 to return.

(11) A signal is output from the control unit W to the solenoid 23 to cause contraction of the plunger of the solenoid 23 to cause angular displacement in the counterclockwise direction in FIG. 1 of the stopper 22 by the force of the not shown torsion coil spring so that the end portion 22*a* is placed immediately below the end portion 20*a* of the hook 20 in the stand-by state.

It should be noted that when the paster arm portion B initiates paper pasting operation to start movement from the stand-by position M to the paper pasting position N. The not shown depressing means acted on the arm 21 is moved away from the arm 21 to release action to the depressing means. Associating with this, angular displacement is caused in the hook 20 to contact the end portion 20*a* of the hook 20 with the end portion 22*a* of the stopper 22 to prevent the hook from moving. Thus, the shaft 5 is placed in a condition where the angular displacement is prevented from.

(12) After termination of pasting of paper, driving of the driving means F for driving the new roll C to rotate is stopped. By this, operation of pasting paper by the paper pasting device can be terminated.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the features set out in the appended claims.

What is claimed is:

1. A paper pasting device having a depressing member depressing a currently consumed paper extracted from one of a plurality of rolls of paper web supported on a support device, onto a pasting portion provided on a paper end of another roll of paper web, which another roll is driven to rotate at a peripheral speed substantially the same as a feeding speed of said currently consumed paper, comprising:

first depressing means cooperatively connected with said depressing member, for urging said depressing member toward said currently consumed paper and depressing said currently consumed paper onto said another roll of the paper web; and brake means, provided adjacent to a first portion of said depressing member and a cooperating member of said depressing member, for restricting bounding of said depressing member caused by a reactive force generated as a result of contact of the first portion contacting the currently consumed paper which causes resilient deformation by a force in a feeding direction applied from said currently consumed paper associated with actuation of said first depressing means, wherein said brake means has a concave curved surface located in mating configuration with the outer periphery of said shaft and substantially complementary with the outer periphery, and said concave curved surface has at least a portion opposing to the feeding direction of said current consumed paper.

2. A paper pasting device as set forth in claim 1, wherein said first depressing means comprises a shaft fixing a base portion of said depressing member, rotatably supported on a frame of said paper pasting device and having a projecting portion projecting from an outer peripheral surface thereof, a spring provided for causing angular displacement of said shaft to urge said depressing member rotating integrally with said shaft, and a stopper preventing said shaft from causing angular displacement against a spring force of said spring, said depressing member being urged toward said currently consumed paper by said spring force of said spring when said stopper is placed in ineffective position.

3. A paper pasting device having a depressing member depressing a currently consumed paper extracted from one of a plurality of rolls of paper web supported on a support device, onto a pasting portion provided on a paper end of another roll of paper web, which another roll is driven to rotate at a peripheral speed substantially the same as a feeding speed of said currently consumed paper, comprising:

first depressing means cooperatively connected with said depressing member, for urging said depressing member toward said currently consumed paper and depressing said currently consumed paper onto said another roll of the paper web;

second depressing means provided separately from said depressing member and actuated after depressing operation of said first depressing means for contacting with a second portion of said depressing member and a cooperating member of said depressing member, and reinforcing depressing force by said depressing member; and brake means, provided adjacent to a first portion of said depressing member and said cooperating member of said depressing member, for restricting bounding of said depressing member caused by a reactive force generated as a result of contact of the first portion contacting the currently consumed paper which causes resilient deformation by a force in a feeding direction applied from said currently consumed paper associated with actuation of said first depressing means.

4. A paper pasting device as set forth in claim 3, wherein said first depressing means comprises a shaft fixing a base portion of said depressing member, rotatably supported on a frame of said paper pasting device and having a projecting portion projecting from an outer peripheral surface thereof, a spring provided for causing angular displacement of said shaft to urge said depressing member rotating integrally with said shaft, and a stopper preventing said shaft from causing angular displacement against a spring force of said spring, said depressing member being urged toward said currently consumed paper by said spring force of said spring when said stopper is placed in ineffective position, said second depressing means has a sleeve portion having an inner diameter greater than an outer diameter of said shaft at one end and includes an arm loosely mounted on the shaft by said sleeve portion and an air cylinder having a rod connected to a tip end of said arm at a tip end thereof in an angularly displaceable fashion and mounted on said frame via a bracket in an angularly displaceable fashion, said arm driven to cause displacement at a contacting position between said shaft and said sleeve portion by actuation of said air cylinder applied a force in a rotating direction of said shaft for reinforcing a depressing force of said depressing member by said spring, and said brake means has a concave curved surface located in mating configuration with the outer periphery of said shaft and substantially complementary with the outer periphery, a base portion mounted on said frame, and said concave curved surface has at least a portion opposing to the feeding direction of said current paper.

* * * * *